US005487536A

United States Patent [19]

McEachin

[11] Patent Number: 5,487,536

[45] Date of Patent: Jan. 30, 1996

[54] BANNER TABLE

[76] Inventor: Jerry F. McEachin, 3999 Williams St., Clarkston, Ga. 30021

[21] Appl. No.: 237,775

[22] Filed: May 4, 1994

[51] Int. Cl.[6] ..... B25B 11/00

[52] U.S. Cl. ..... 269/21; 269/286; 269/295; 269/307

[58] Field of Search ..... 108/182, 185, 108/153; 269/21, 307, 295, 286, 285, 88, 901

[56] References Cited

U.S. PATENT DOCUMENTS 2,133,518 10/1938 Huebner .
2,814,233 11/1957 Anander .
3,222,051 12/1965 Bevilacqua .
3,421,459 1/1969 Sherwood ..... 108/153
4,100,676 7/1978 Ferguson ..... 269/295
4,582,305 4/1986 Brothers .
4,972,749 11/1990 Grove ..... 269/307
5,222,719 6/1993 Effner ..... 269/21

*Primary Examiner*—Robert C. Watson
*Attorney, Agent, or Firm*—Kenneth S. Watkins, Jr.

[57] ABSTRACT

A cutting table is disclosed which can be used to cut workpieces such as banners. The device comprises a hard-surfaced vacuum table, with a rectangular grid pattern of cutting grooves. One or more raised measuring guides allow quick and accurate alignment and measurement of work-pieces. The device is designed for expansion by connection to one or more additional banner tables.

8 Claims, 3 Drawing Sheets

BANNER TABLE

BACKGROUND OF THE INVENTION

The present invention relates to cutting tables for large workpieces such as banners.

In the sign and banner industry, large workpieces are generally laid out on a worktable for cutting. In most cases, the worktable has a relatively soft or easily scratched top surface, such as wood, plastic, or glass. These surfaces quickly become marred by the use of knives on the tables and must be replaced frequently.

In current practice, a person must position the material from which a workpiece is to be cut on the worktable, climb up on the table, measure the workpiece, and then cut the material with either scissors or a knife and straight edge. This very time consuming procedure is awkward and imprecise. Cutting large workpieces with a knife on a flat worktable quickly results in marring the table top surface and, in the case of glass table tops, in rapid dulling of the knife blade.

A number of devices have been disclosed in the past to address one or more of these problems. U.S. Pat. No. 4,582,305 by Brothers discloses a device for cutting sheet material into predetermined shapes which employs grooves in the cutting surface for guiding a cutting instrument. These grooves, however, are arranged to facilitate the cutting of predetermined shapes and lack the flexibility necessary to cut a large number of rectangular shapes and sizes of banners and other workpieces. This and other devices also lack a means for quickly positioning and measuring workpieces and further lack a convenient means of expanding the cutting surface to accommodate very large workpieces.

OBJECTS OF THE INVENTION

Therefore, one objective of the present invention is to provide a device to quickly position and hold large workpieces.

Another objective of the present invention is to provide for the quick and accurate measuring of large workpieces.

A further objective of the present invention is to provide for flexibility in the cutting of workpieces through the use of a plurality of cutting grooves arranged in a rectangular pattern.

An additional objective of the current invention is to provide a device with a hard cutting surface that will resist marring.

Yet another objective of the current invention is to provide a device that can be connected to another like device to provide an enlarged work surface.

An objective of an alternative embodiment of the current invention is to provide a device with part of its work surface fitted with cutting grooves and vacuum apertures for measuring and cutting of workpieces and with the rest of its work surface completely flat for more general work, such as drawing of marking workpieces.

SUMMARY

The current invention is a table for cutting workpieces, such as banners, which addresses the shortcomings of previous designs and current practice. The device comprises a table with a hard top surface with a rectangular grid pattern of cutting grooves for accurately cutting a large number of rectangular shapes and sizes of workpieces. A plurality of vacuum apertures hold the workpiece in place. A vacuum means is connected to a vacuum chamber below the top surface. At least one measuring guide is installed along an edge of the top surface.

In the preferred embodiment, the top surface is steel. At least one measuring guide is raised above the top surface for quickly aligning the workpiece. Measuring guides along the ends of the top surface are removable, and means are provided to align and clamp tables together.

In an alternative embodiment, the current invention has part of the table top surface fitted with cutting grooves and vacuum apertures, while the remainder of the top surface is smooth.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

The following description discloses a cutting table which is used for quick and accurate alignment and cutting of workpieces, typically large banners.

Figure 1:
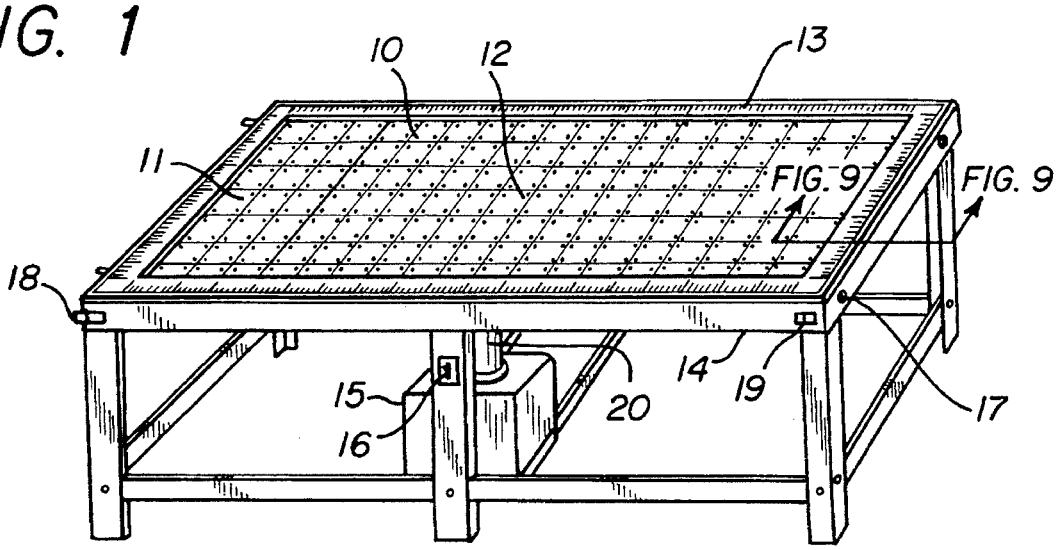
FIG. 1 is an oblique drawing of the preferred embodiment of the present invention.

FIG. 1 shows an oblique view of the preferred embodiment of the worktable or banner table. The top surface 10 is made of a hard material, such as steel or other metal, which is resistant to cutting. The top surface 10 has a plurality of cutting grooves 11 arranged in a rectangular grid pattern for guiding a cutting instrument. The rectangular grid pattern allows fast, accurate cutting of a large number of rectangular sizes of workpieces. The grooves are V-shaped and are spaced at regular intervals. The spacing of the grooves is dependent upon the application. For banners, the spacing is typically six inches. A plurality of apertures 12 penetrate the top surface 10. The top surface 10 serves as the top side of a table top assembly 14. The table top assembly 14 serves as a vacuum chamber, which provides vacuum to the apertures 12. With a workpiece positioned on the table top assembly 14 and vacuum applied to the apertures 12, a pressure differential is created across the workpiece which serves to hold the workpiece in place yet allow easy repositioning of the workpiece. A vacuum means 15, such as a vacuum blower, is connected to the vacuum chamber 53 of FIG. 5 of the table top assembly 14 by a plenum 20. An electric switch 16 controls operation of the vacuum means.

Measuring guides 13 for measuring a dimension of the workpiece are attached along the edges of the table. In the preferred embodiment, at least two adjacent measuring guides 13 are raised to allow alignment of a workpiece, such as a banner, to a corner of the top surface 10. One end of the table top assembly 14 contains two alignment holes 17. A clamp 18 at one end of the table is used to attach to a clamp catch 19 at the opposite end of an adjacent table in order to join adjacent tables.

Figure 2:
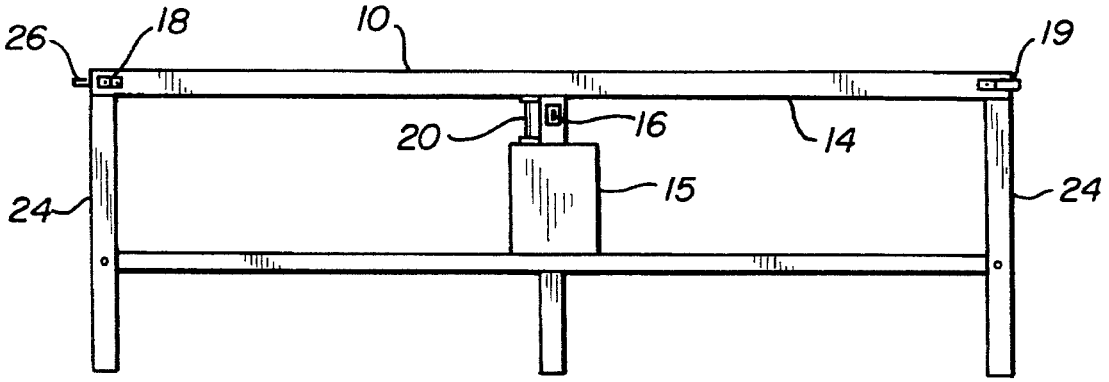
FIG. 2 is a front elevation of FIG. 1.

FIG. 2 is a front elevation of the preferred embodiment of the present invention showing one of the two alignment pins 26. When inserted into the alignment holes 17, alignment pins 26 achieve precise alignment to adjacent tables. Precise alignment is necessary to ensure that a cutting blade remains in the cutting groove 11 when cutting across adjacent tables.

Figure 3:
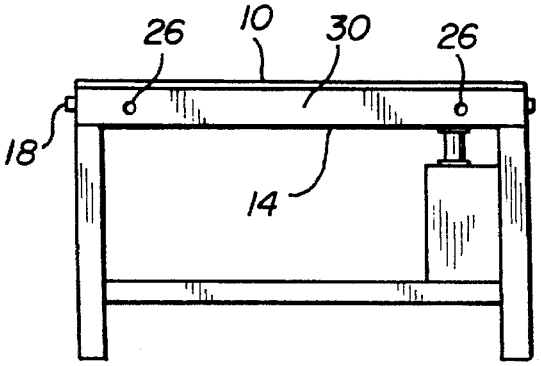
FIG. 3 is a left side elevation of FIG. 1.

FIG. 3 is a left side elevation of FIG. 1 showing two alignment pins 26 attached to end 30. A clamp 18 is located on each side of the table top assembly 14.

Figure 4:
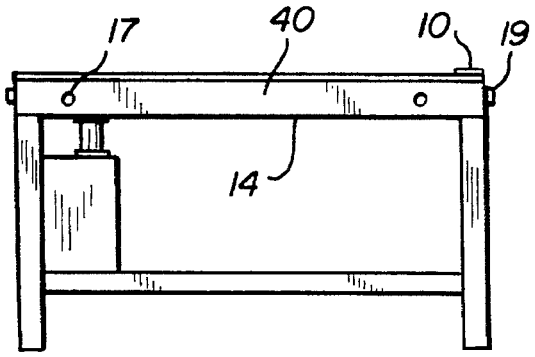
FIG. 4 is a right side elevation of FIG. 1.

FIG. 4 is a right side elevation of FIG. 1 showing two alignment holes 17 in opposite end 40. A clamp catch 19 is located on each side of the table top assembly 14.

Figure 5:
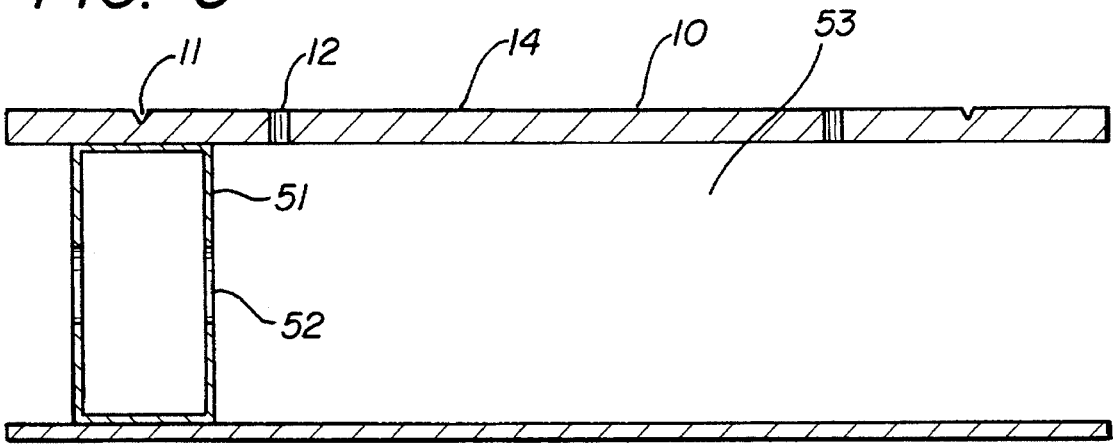
FIG. 5 is a cross section detail of the table top assembly.

FIG. 5 is a cross section of the table top assembly 14 showing two V-shaped cutting grooves 11 for guiding a cutting instrument and the penetration of the top surface 10 by two apertures 12. A vacuum chamber support member 51 is penetrated by holes 52 to allow a uniform vacuum throughout the table top assembly 14.

Figure 6:
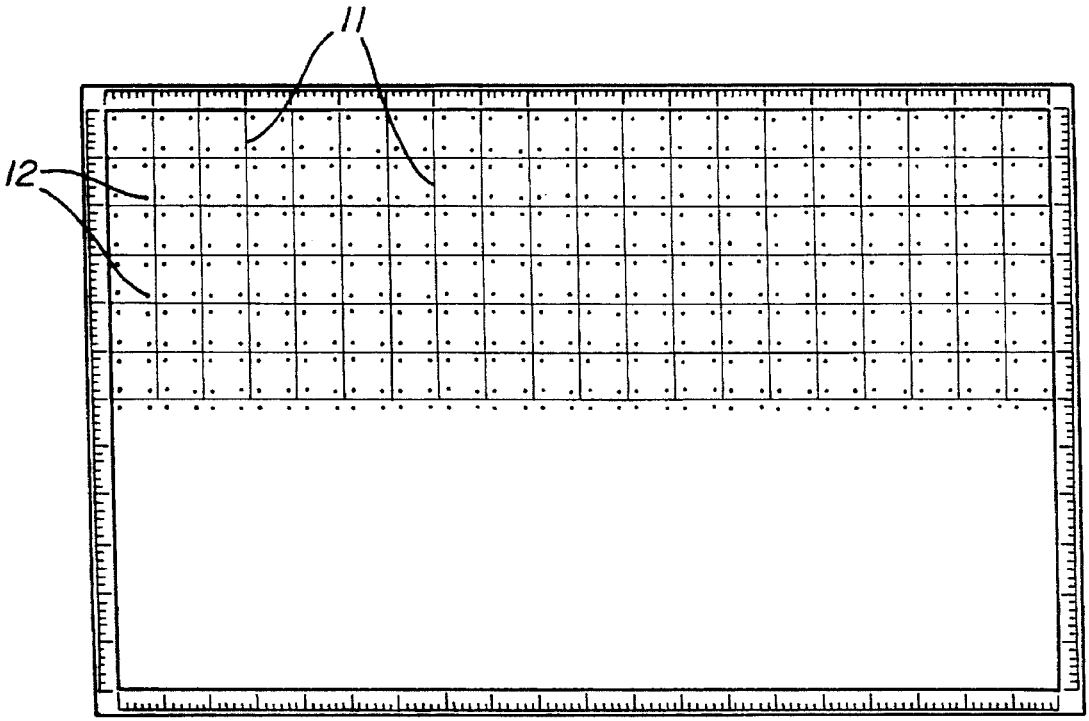
FIG. 6 is a plan view of the top of an alternative embodiment of the present invention.

FIG. 6 is a plan view of the top of an alternative embodiment of the present invention where part of the top surface 10 is free of cutting grooves 11 and apertures 12 in order to provide an unencumbered auxiliary work area.

Figure 7:
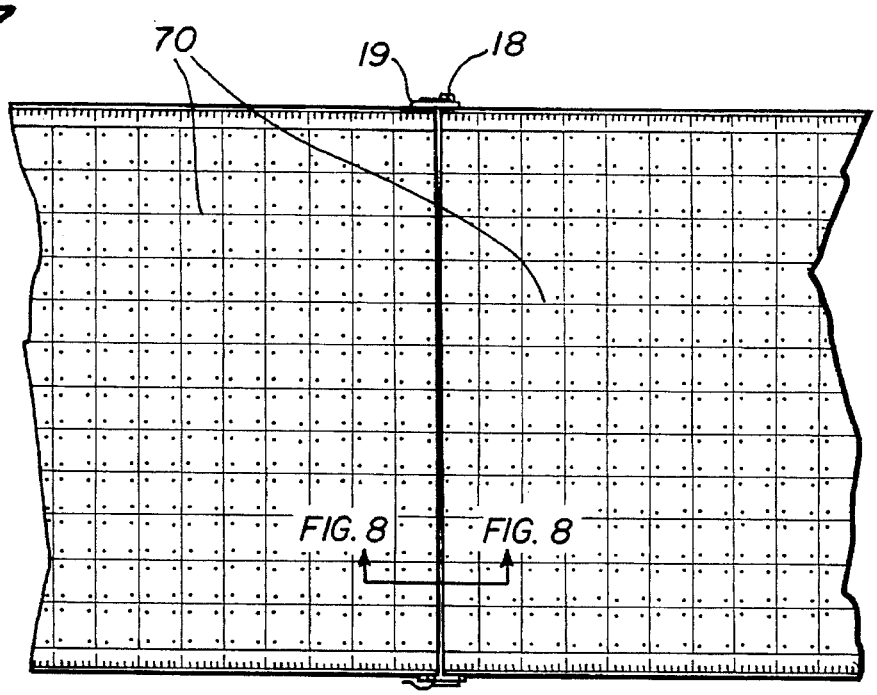
FIG. 7 is a detail of two examples of the present invention connected at their ends.

FIG. 7 is a detail plan view of the ends of two adjacent banner tables connected together by a clamping means comprising two clamps 18 on one table attached to two clamp catches 19 on the adjacent table. The clamping means ensure that adjacent ends of the tables are in contact to allow smooth cuts of the workpiece across the joint between adjacent tables. Longitudinal cutting grooves 70 (those cutting grooves 11 running lengthwise on the banner table) extend to the table top surface 10 ends, so that they may be aligned with corresponding longitudinal cutting grooves 70 of an adjacent banner table. The top surface 10 must extend at least to the edge of the frame 24 below the top surface 10 as shown in FIG. 2 for the banner tables to be placed together in the manner described.

Figure 8:
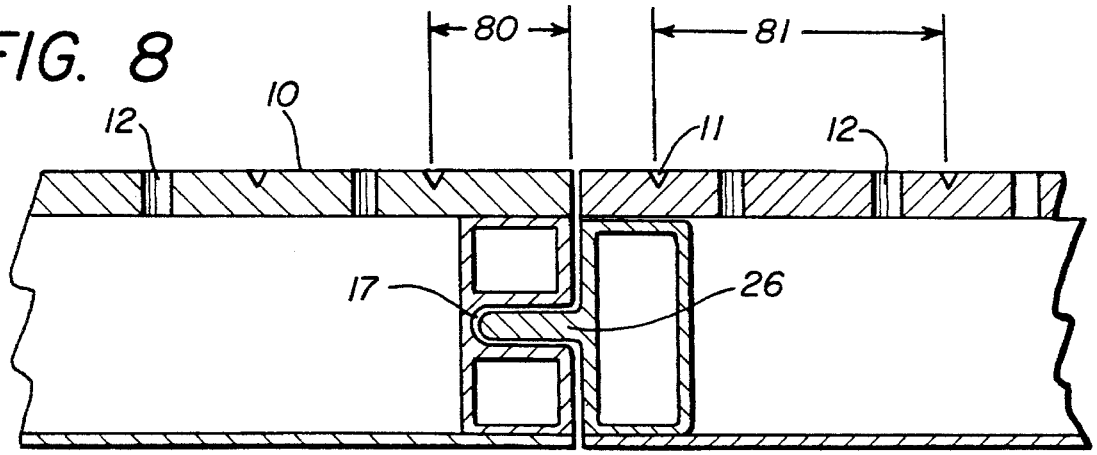
FIG. 8 is a cross section of the table top assemblies in FIG. 7.

FIG. 8 is a detail cross section of the table top assemblies depicted in FIG. 7 showing the fit of an alignment pin 26 in an alignment hole 17. The fit of the alignment pin 26 into the alignment hole 17 constitutes the alignment means for aligning the cutting grooves of adjacent tables. The distance from the end edge of the top surface 10 to the cutting grooves 11 closest to the ends of the table (distance 80) is half the distance between adjacent cutting grooves 11 (distance 81 ). This ensures that the distance between the last cutting grooves 11 of the two joined tables is equal to the distance between all other cutting grooves 11 on the tables.

Figure 9:
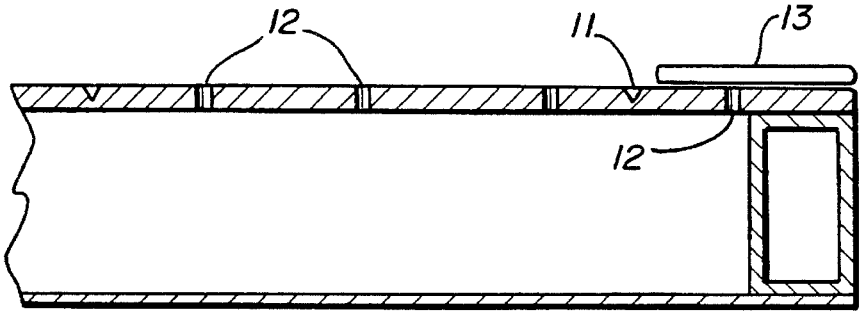
FIG. 9 is a cross section of the end of the table top assembly in FIG. 1.

FIG. 9 is a detail cross section of the end of a table top assembly 14 with a measuring guide 13 attached by removable fasteners, not shown. The measuring guide 13 is raised above the top surface 10 for fast alignment of the workpiece with the rectangular cutting grid. The measuring guide 13 is removable to provide a continuous flat working surface when the banner table is attached to an adjacent banner table. The aperture 12 that is covered by the measuring guide 13 becomes usable for holding down workpieces only when the measuring guide 13 is removed. Accordingly the reader will see that the banner table comprises the following advantages:

- it is simple and can be manufactured at low cost,
- it securely holds the workpiece in place on the top surface,
- it has a hard top surface which is resistant to cutting,
- it allows quick alignment of workpieces on the top surface,
- it allows quick measurement of workpieces,
- it is versatile due to the rectangular grid pattern of cutting grooves in the top surface, and
- it can be expanded by connecting additional banner tables end to end.

Although the description above contains many specifications, these should not be construed as limiting the scope of the invention but as merely providing illustrations of some of the presently preferred embodiments of this invention. For example, clamps and alignment pins and holes may be added to the device to clamp adjacent tables at all four ends of the table, etc.

Thus the scope of the invention should be determined by the appended claims and their legal equivalents, rather than by the examples given.

I claim:

1. A table for cutting banners, the device comprising:

(a) a top surface of steel;

(b) a plurality of V-shaped grooves in the top surface for guiding a cutting instrument, the grooves having a rectangular grid pattern on the top surface and the grooves extending to an edge of the top surface;

(c) a measuring guide along each edge of the top surface for measuring a dimension of the banner, at least two adjacent guides raised to allow alignment of the banner to a corner of the top surface, and at least one measurement guide being removable;

(d) a clamp to clamp an end of a first table to an end of a second table;

(e) at least one alignment pin to align the grooves of the ends of the first and second tables;

(f) a vacuum chamber below the top surface;

(g) a vacuum means connected to the chamber; and (h) a plurality of apertures between the top surface and the vacuum chamber to secure the banner to the top surface.

2. A table for cutting a banner, the table comprising:

(a) a top surface of a hard material which is resistant to cutting, the top surface comprising two adjacent edges;

(c) a plurality of cutting grooves in the top surface for guiding a cutting instrument, the grooves forming a rectangular grid pattern on the top surface;

(d) a vacuum chamber disposed in the table below the top surface;

(e) a vacuum blower disposed in the table, the vacuum blower connected to the chamber by a plenum;

(f) a plurality of apertures between the top surface and the chamber to secure the banner to the top surface when a vacuum is maintained in the chamber, and (g) a measuring guide disposed on each of the two adjacent edges of the top surface for measuring and positioning the banner wherein at least one said measuring guide is outside of said plurality of cutting grooves.

3. The table of claim 2 wherein said at least one said measuring guide is raised above the top surface for aiding the alignment of the banner on the top surface.

4. The table of claim 2 wherein said measuring guide disposed on each of the two adjacent edges is raised above the top surface for aiding the alignment of the banner on the top surface.

5. The table of claim 2 comprising a plurality of longitudinal grooves extending to two opposite edges of the top surface.

6. A first table according to claim 5 comprising a clamp for clamping the first table to a second table, the second table being identical to the first table, wherein the plurality of longitudinal grooves of the first table are aligned with a second plurality of longitudinal grooves of the second table.

7. The first table of claim 6 comprising an alignment pin in an end of the first table.

8. The table of claim 2 wherein the top surface is made of metal.

* * * * *